US010406646B2

(12) United States Patent
Schneider et al.

(10) Patent No.: US 10,406,646 B2
(45) Date of Patent: Sep. 10, 2019

(54) DEVICE AND METHOD FOR MACHINING OF AN OPTICAL LENS

(75) Inventors: Gunter Schneider, Marburg (DE); Helwig Buchenauer, Dautphetal-Buchenau (DE); Ulf Börner, Marburg (DE); Klaus Krämer, Dautphetal-Friedensdorf (DE)

(73) Assignee: SCHNEIDER GMBH & CO. KG, Fronhausen (DE)

( * ) Notice: Subject to any disclaimer, the term of this patent is extended or adjusted under 35 U.S.C. 154(b) by 1069 days.

(21) Appl. No.: 14/002,761

(22) PCT Filed: Feb. 28, 2012

(86) PCT No.: PCT/EP2012/000855
§ 371 (c)(1),
(2), (4) Date: Oct. 23, 2013

(87) PCT Pub. No.: WO2012/116803
PCT Pub. Date: Sep. 7, 2012

(65) Prior Publication Data

US 2014/0038494 A1 Feb. 6, 2014

(30) Foreign Application Priority Data

Mar. 1, 2011 (EP) ..... 11001650

(51) Int. Cl.

| | |
|---|---|
| ***B24B 1/00*** | (2006.01) |
| ***B24B 5/16*** | (2006.01) |
| ***B24B 13/00*** | (2006.01) |
| ***B24B 13/04*** | (2006.01) |

(52) U.S. Cl.
CPC ..... *B24B 1/00* (2013.01); *B24B 5/16* (2013.01); *B24B 13/00* (2013.01); *B24B 13/043* (2013.01)

(58) Field of Classification Search
CPC ..... B24B 13/0031; B24B 13/0037
USPC ..... 451/5, 10, 42, 43, 277, 240, 255
See application file for complete search history.

(56) References Cited

U.S. PATENT DOCUMENTS

| | | | | |
|---|---|---|---|---|
| 5,144,561 | A * | 9/1992 | Soper | G05B 19/4207 451/5 |
| 5,231,587 | A | 7/1993 | Frost | |
| 7,422,510 | B2 | 9/2008 | Schneider et al. | |
| 7,455,569 | B2 * | 11/2008 | Schafer | B24B 13/0037 451/11 |
| 7,739,778 | B2 | 6/2010 | Fiedler et al. | |
| 8,460,062 | B2 | 6/2013 | Schneider | |
| 2002/0006764 | A1 * | 1/2002 | Hanisch | B23Q 1/52 451/1 |

(Continued)

FOREIGN PATENT DOCUMENTS

| | | |
|---|---|---|
| DE | 197 51 750 A1 | 6/1999 |
| EP | 1 704 963 A1 | 9/2006 |
| FR | 2 528 748 A1 | 12/1983 |

*Primary Examiner* — Monica S Carter
*Assistant Examiner* — Lauren M Beronja
(74) *Attorney, Agent, or Firm* — David S. Safran; Roberts Mlotkowski Safran Cole & Calderon, P.C.

(57) ABSTRACT

A device and a method for polishing of an optical lens by means of rotary tool are proposed, a fixture for the lens being pivotable around a pivoting axis transversely to the axis of rotation by means of a push-rod adjustment and being pivotable up out of a machining position such that the lens can be changed from overhead. This allows a compact structure and easy changing of the lens.

23 Claims, 4 Drawing Sheets

(56) References Cited

U.S. PATENT DOCUMENTS

| | | | | |
|---|---|---|---|---|
| 2003/0190872 | A1* | 10/2003 | Arai | B24B 9/146 451/42 |
| 2004/0229553 | A1* | 11/2004 | Bechtold | B24B 13/01 451/42 |
| 2005/0202754 | A1* | 9/2005 | Bechtold | B24B 13/06 451/5 |
| 2008/0051015 | A1* | 2/2008 | Schneider | B24B 13/0031 451/67 |
| 2011/0084433 | A1 | 4/2011 | Fiedler et al. | |

* cited by examiner

DEVICE AND METHOD FOR MACHINING OF AN OPTICAL LENS

BACKGROUND OF THE INVENTION

Field of the Invention

This invention relates to a device for machining, especially polishing, of an optical lens and to a method for machining, especially polishing, of an optical lens.

Description of Related Art

An optical lens, for example, for eyeglasses, should have certain optical properties. The associated desired optical data of the lens are determined for example, by an optician. The lenses are then machined or fabricated depending on the respectively desired optical data, the lens being provided especially with so-called free-form surfaces (for example, progressive lenses, etc). The following description and this invention relate especially to these lenses and lens blanks which are machined according to the desired individualized optical data and are provided in particular with so-called free-form surfaces.

This invention relates especially preferably to the machining or polishing of an optical lens. In general this also applies to the machining or polishing of some other optical component, such as a mirror or the like. Accordingly the term "optical lens" should also be understood preferably in a wide sense such that it comprises other optical components. But in the following only the machining and polishing of an optical lens are the focus. Statements and explanations in this respect therefore also apply preferably accordingly to the machining or polishing of some other optical component.

German Patent Application DE 10 2007 042 667 A1 and corresponding U.S. Pat. No. 8,460,062 B2 show a polishing device for optical lenses. The polishing device has two fixtures for holding blocked lenses which are to be polished and assigned motors for rotating the lenses in the machining. The lenses with their surface to be polished during machining point at least essentially down and are located in a working space. The fixtures and the assigned motor are each located on a U-shaped swivel arm which is mounted outside the working space and which can be pivoted around a horizontal pivoting axis to a very limited degree. The motors are located on the swivel arms outside the working space. The polishing device has polishing tools which are located under the lenses and which can be turned respectively by an assigned rotary drive. The axes of rotation run vertically. The polishing tools can be fed axially, therefore in the vertical direction. The swivel arms are located in a slide and can be moved in the horizontal direction so that transverse adjustment of the lenses relative to the polishing tools is enabled.

International Patent Application Publication WO 2005/105372 A1 and corresponding U.S. Pat. No. 7,422,510 B2 show a similar polishing device for optical lenses. The polishing device has two fixtures for holding blocked lenses which are to be polished and assigned motors for rotating the lenses in the machining. The lenses with their surface to be polished during machining point at least essentially down and are located in a working space. The fixtures and the assigned motor are each located on a swivel arm which can be pivoted around a horizontal pivoting axis to a very limited degree. The polishing device has polishing tools which are located under the lenses and which can be turned respectively by an assigned rotary drive. The axes of rotation run vertically.

German Patent Application DE 197 51 750 A1 discloses a polishing device for optical lenses. The polishing device has one fixture for holding a blocked lens which is to be polished, with an assigned motor for rotating the lens in the machining. The fixture or lens points up. The axis of rotation runs at least essentially vertically during machining. The motor for rotating the lens and the fixture with the lens can be pivoted around a horizontal pivoting axis to a very limited degree. The polishing device has polishing tools which are located above the lens and which can be turned respectively by an assigned rotary drive. The axes of rotation run vertically.

European Patent Application EP 2 308 644 A2 and corresponding U.S. Patent Application Publication 2011/0084433 A1 disclose a device for precision machining of lenses. The device has tool spindles with horizontal axes of rotation for rotating the lenses which are to be machined. The workpiece spindles cannot be swiveled.

U.S. Pat. No. 5,231,587 A discloses a device for machining of lenses, the device having a workpiece spindle with a horizontal axis of rotation for a lens to be machined and a rotary drive for a tool with a horizontal axis of rotation, the workpiece spindle and the rotary drive each being pivotable around a vertical pivoting axis.

SUMMARY OF THE INVENTION

The object of this invention is to devise a device and a method for machining, especially polishing, of an optical lens, a simple and/or durable structure being enabled or facilitated, changing of the lens being simplified or facilitated and/or greater pivoting of the lens to be machined relative to the assigned tool with a simultaneously compact structure of the device being enabled or facilitated.

This object is achieved by a device by a method as described herein.

One aspect of this invention is that a fixture for a lens can be pivoted by means of a push-rod adjustment around a pivoting axis transversely to the axis of rotation. In particular, the motor together with the fixture is located in a working space and can be pivoted especially preferably with the fixture. This allows a compact structure and a pivoting of the lens to be machined which is greater than in the prior art. In particular, in this way, lenses matched to a head shape and/or lenses with side regions made longer, such as sports eyeglasses or fashion eyeglasses, can be better machined or polished since as suggested larger machining and pivoting paths than in the prior art are enabled. Furthermore, a simple and/or durable structure is enabled.

According to another aspect of this invention, the fixture or lens is pivoted up to change the lens such that the fixture points up and/or the lens can be changed from overhead. This significantly facilitates the changing of the lens, especially for manual changing of the lens. Furthermore this allows or facilitates a compact structure.

According to another aspect of this invention, the tool is turned around an at least essentially horizontal axis, the lens rotating around an axis of rotation which is canted or pivoted and tilted to the axis of rotation, the lens being adjusted or moved in the vertical direction. This enables a simple, durable and/or compact structure. Furthermore, changing of the lens and tool is facilitated or simplified. In particular, the lens and the tool can be moved apart from one another in the vertical direction for changing and/or can be pivoted toward one another, especially can be pivoted away from one another.

According to still another aspect of this invention, the fixture or lens can be pivoted relative to the axis of rotation of the tool, especially preferably essentially by 90° so that lateral changing of the lens or changing of the lens from overhead is facilitated or enabled. This facilitates or enables a compact structure. In particular, specifically, it is necessary to move the fixture or the lens, on the one hand, and the tool or rotary drive of the tool, on the other hand, linearly apart from one another only to a limited extent. Furthermore, independent changing of the lens on the one hand and the tool on the other is enabled or facilitated especially preferably by corresponding changing apparatus for automated changing.

Especially preferably, the axis of rotation of the tool runs at least essentially horizontally. This is conducive to a compact structure.

The suggested device and the suggested method especially allow the implementation of a low structure and/or operation from overhead, especially preferably by a user standing laterally next to it or in front of it. This facilitates not only the operation, but especially also a cleaning of the working space.

The drive or drives for push-rod adjustment are especially preferably located outside the working space and especially underneath the working space. This is conducive to the preferred accessibility or operation from overhead and/or a low structure.

Individual aspects and features of the aforementioned and following aspects and features of this invention can be optionally combined with one another, but also can be implemented independently of one another.

Other aspects, features, advantages and properties of this invention will become apparent from the following description of a preferred exemplary embodiment with reference to the accompanying drawings.

DETAILED DESCRIPTION OF THE INVENTION

For the same or same type of components and apparatus, the figures use the same reference numbers, the same or corresponding advantages and properties arising even if a repeated description is omitted.

The subject matter of the invention is a device 1 for machining, especially polishing of an optical lens 2 or some other optical component, even if only lenses as the preferred workpiece and polishing are addressed below.

The starting point for the formation and machining of an optical lens 2 is a lens blank. It is machined by cutting or some other profiling and in further machining steps such that at the end there is an optical lens 2 with the desired optical properties which is finished with respect to the machining of the surface geometry. The term "lens" within the scope of this invention designates preferably both the lens blank before carrying out the necessary machining steps, and also the finished lens 2 at the end.

The lens 2 or lens blank preferably made of plastic. However, fundamentally, also some other material which can be suitably machined, optionally also glass or mineral glass, can be used. If the finished lens 2 is to be used for eyeglasses (not shown), which is preferably the case, the lens 2 of this invention is also called spectacle glass, even if the lens 2 may not necessarily be made of glass.

Figure 1:
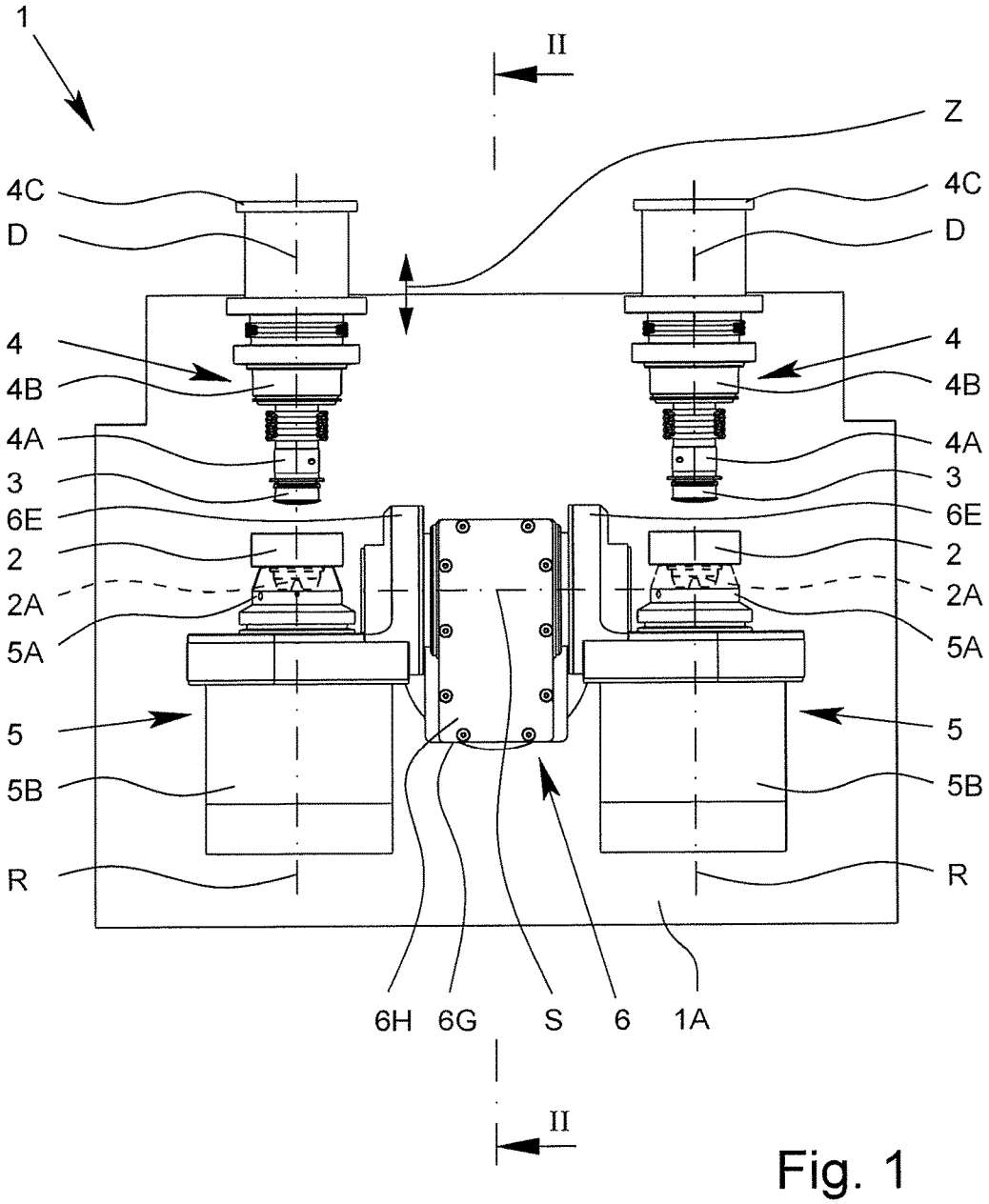
FIG. 1 is a schematic plan view of a proposed device.

FIG. 1 is a schematic plan view of the suggested device 1 for polishing of at least one lens 2, here at the same time two lenses 2.

The device 1 has preferably a working space 1A in which polishing takes place. The working space 1A is closed during machining or polishing.

The polishing takes place by means of a tool (polishing tool) 3 which especially turns or can be turned. In the illustrated example, there are preferably two tools 3 in order to enable the simultaneous polishing of two lenses 2.

The device 1 has a tool drive 4 in order to drive the tool 3, especially to set it into rotation. The tool 3 can therefore be turned around an axis of rotation D by means of the assigned tool drive 4. In the illustrated example, the device 1 has two tool drives 4 in order to be able to drive the two tools 3 which are intended for simultaneous machining of the two lenses 2. However, other designs are also possible. For example, there can be a common tool drive 4 for both tools 3.

The axes of rotation D of the tools 3 or tool drive 4, in the illustrated example, run preferably at least essentially horizontally and/or parallel to one another.

The device 1 preferably has a lens drive 5 for rotating the lens 2 which is to be machined, therefore polished. The lens 2 can be rotated around an axis of rotation R by means of the lens drive 5.

In the illustrated example, the device 1 preferably has two lens drives 5 in order to be able to polish preferably two lenses 2 at the same time. Fundamentally, however, there can also be a common lens drive 5 for the two lenses 2.

The lens drive 5 or each lens drive 5 in the illustrated example preferably has a fixture 5A for holding or clamping the assigned, preferably blocked lens 2, especially preferably a blocking piece 2A of the lens 2, and an assigned motor 5B for driving or rotating the assigned fixture 5A and lens 2.

The fixture 5A can alternatively also directly chuck, hold or clamp the lens 2.

The lens drive 5 or the motor 5B is preferably together with the assigned fixture 5A located in the working space 1A. In the illustrated example, therefore, there are two lens drives 5 or motors 5B for driving the lenses 2 in the working space 1A of the device 1.

The device 1 is preferably made such that the fixture 5A or lens drive 5—therefore especially together with the assigned motor 5B—can be pivoted around a pivoting axis S. The pivoting axis S runs preferably transversely, especially perpendicular to the axis of rotation R. The pivoting axis S preferably intersects the axis of rotation R or axes of rotation R.

In the illustrated example, the two fixtures 5A or lens drives 5 can preferably be pivoted around the common pivoting axis S and/or only jointly.

The axes of rotation R of the two lenses 2 or lens drives 5 or motors 5B in the illustrated example run preferably parallel to one another.

The pivoting axis S runs preferably at least essentially horizontally.

The pivoting axis S runs preferably through the working space 1A.

The pivoting axis S runs preferably transversely, especially perpendicular to the axis of rotation D or axes of rotation D.

When the lens 2 is being polished or machined in the machining position which is shown in FIG. 1 and in which the fixture 5A and lenses 2 point at the tools 3, the respective axis of rotation R runs preferably at least essentially horizontally and/or at least essentially in an extension of the axis of rotation D.

The device 1 preferably has a push-rod adjustment 6 for holding and/or pivoting of the lens drive 5 or motor 5B or lens(es) 2, fixture(s) 5A or lens drives 5 and/or motors 5B.

Figure 2:
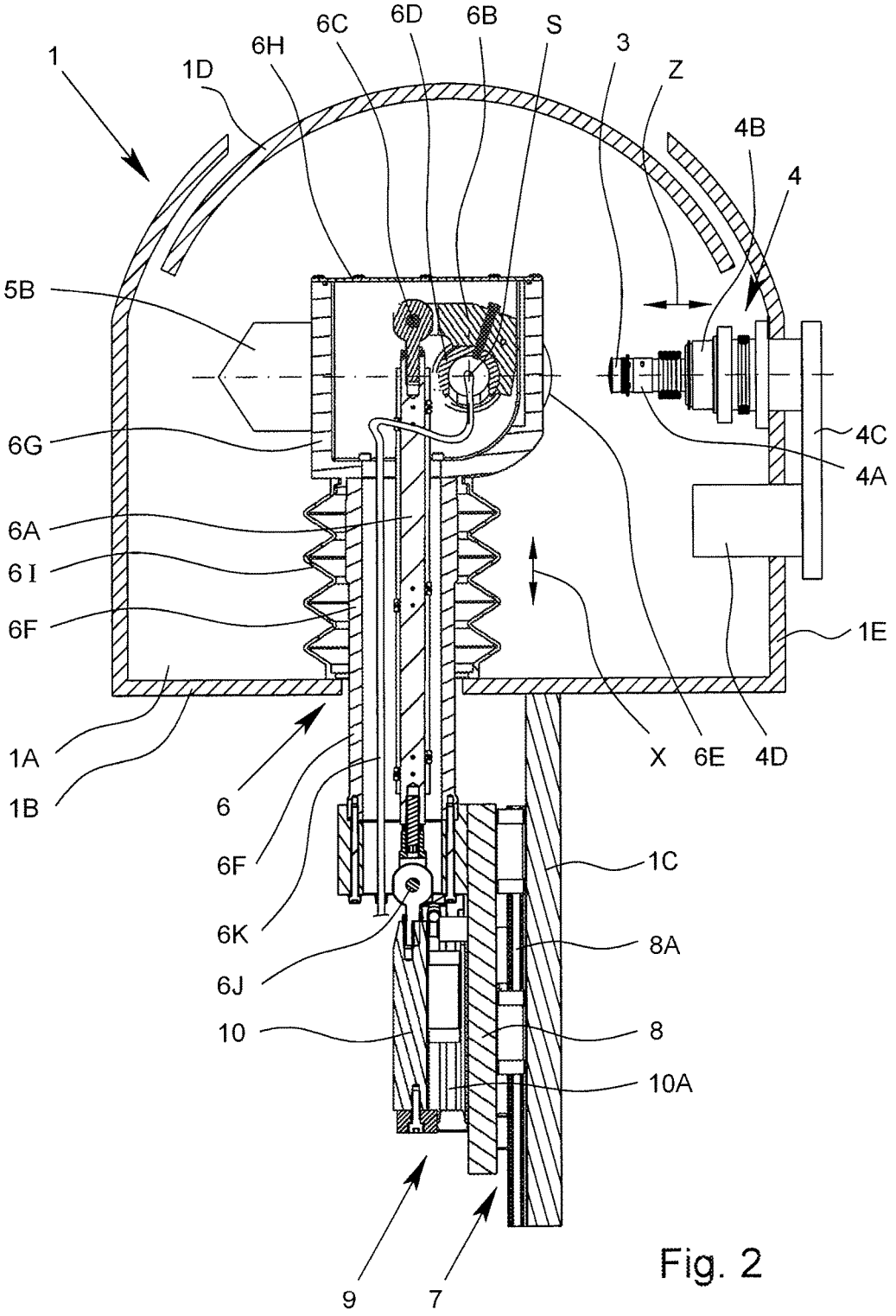
FIG. 2 is a schematic section of the device taken along line II-II in FIG. 1.
Figure 3:
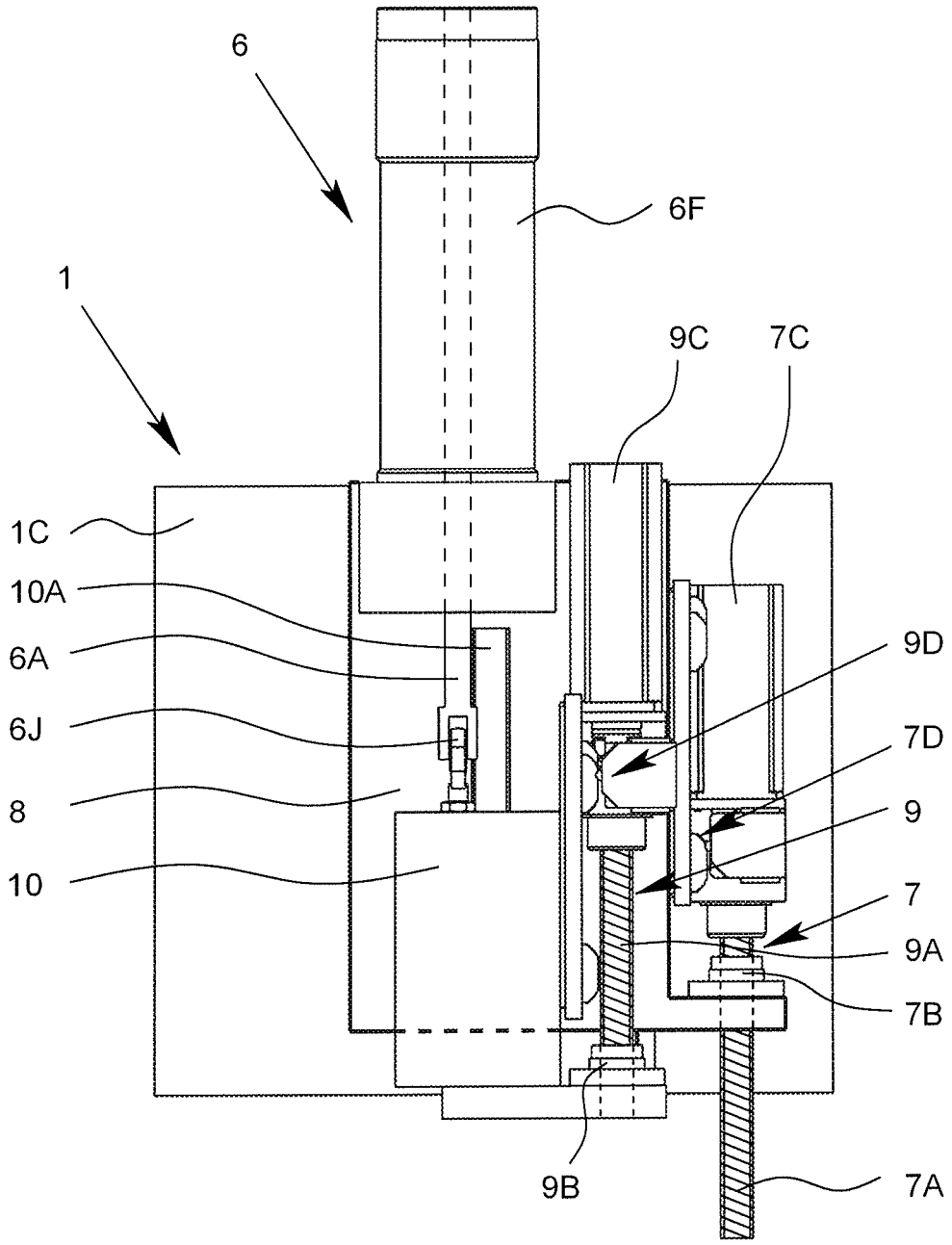
FIG. 3 is a schematic side view of a lower part of a push-rod adjustment of the device.

FIG. 2 shows the device 1 and the push-rod adjustment 6 in a schematic section taken along line II-II in FIG. 1, therefore in a vertical section. FIG. 3 shows a lower part of the push-rod adjustment 6 in a schematic side view.

The push rod adjustment 6 is used preferably for the aforementioned pivoting of the fixture(s) 5A or lens(es) 2 around the pivoting axis S. The push-rod adjustment 6, for this purpose, preferably has a push-rod 6A as shown in FIG. 2. The push-rod 6A can be made in one part or several parts.

The push-rod 6A preferably acts on a cam or swivel arm 6B in order to transfer or convert the at least essentially linear push-rod motion into a rotary or pivoting movement. The push-rod 6A, in the illustrated example, is articulated via a joint 6C to the swivel arm 6B. The swivel arm 6B is connected in a torsionally strong manner, for example, via a shaft segment 6D and/or a holder 6E, to the lens drive 5 or two holders 6E to the lens drives 5.

The holders 6E in the illustrated example are preferably made angled, as is especially apparent from FIG. 1. The holders 6E are, for example, each tightly connected to the assigned motor 5B or hold it. The motor 5B for its part keeps the assigned fixture 5A rotatable.

The push-rod adjustment 6 has preferably a retaining element 6F which is hollow and/or tubular and/or has a retaining head 6G, especially preferably for the rotary mounting of the swivel arm 6B, here, especially via the shaft segment 6D. In the illustrated example, the end of retaining element 6F which projects into the working space 1A bears the retaining head 6G.

The pivot support or swivel arm 6B and the push-rod 6A are preferably encapsulated and protected or covered in the working space 1A, in the illustrated example, by the retaining element 6F which gives or holds the push-rod 6A and/or by the retaining head 6G. Especially preferably, the retaining head 6G is connected to the hollow retaining element 6F such that it closes it. The retaining head 6G, in the illustrated example, for its part is preferably closed by a removable cover 6H or the like, especially preferably on the top.

The retaining element 6F and the push-rod 6A are preferably routed out of the working space 1A or end outside it.

The push-rod adjustment 6 or the retaining element 6F is preferably routed out of the working space 1A through an opening, especially of the bottom 1B of the device 1 or of the working space 1A. For sealing purposes, there is preferably a corresponding sealing element, here a bellows 6I, which in the illustrated example, on the one hand, is attached to the wall or the bottom 1B, and on the other hand, to the retaining element 6F or retaining head 6G on the end side. In particular, the sealing element or the bellows 6I is made such that a linear or axial movement of the push-rod adjustment 6 or retaining element 6F is possible in the illustrated example in the vertical direction as indicated by a double-headed arrow X in FIG. 2 without adversely affecting the seal.

The device 1 or the push-rod adjustment 6 preferably has a first drive 7 for at least essentially linear adjustment or displacement of the fixture(s) 5A or lens(es) 2 or the push-rod adjustment 6 or the pivoting axis S, especially transversely to the axis of rotation D, in the vertical direction and/or in the X direction, as is apparent from the schematic side view of a lower part of the device 1 or of the push-rod adjustment 6 according to FIG. 3.

Therefore, the first drive 7 enables the movement or the cross feed of the lens 2 relative to the assigned tool 3. In particular, a computed or controlled linear axis is formed.

In the illustrated example, the first drive 7 is located preferably outside of the working space 1A, especially underneath the bottom 1B and/or in a lower region of the device 1.

The device 1, the push-rod adjustment 6 or the first drive 7 preferably has a first slide 8 for linear guidance of the push-rod adjustment 6 or retaining element 6F. The first slide 8 therefore enables the adjustment or displacement in the X direction. In the illustrated example, the retaining element 6F is tightly connected, especially screwed, in particular in the region of its outer free end, to the first slide 8, optionally via a corresponding adapter. Especially preferably the first slide 8 which is made especially plate-like is connected laterally and/or in an extension to the preferably elongated and/or hollow section-like or tubular retaining element 6F.

The first slide 8 is movably guided especially on one base part 1C of the device 1 and/or a rail 8A, preferably in the X direction or in the longitudinal direction of the retaining element 6F and/or push-rod adjustment 6.

The first drive 7 is preferably made as a linear drive.

The first drive 7, in the illustrated example, preferably has a threaded spindle 7A for linear adjustment of the first slide 8. Especially preferably, the first drive 7 has a ball screw which is formed preferably by the threaded spindle 7A and an assigned thread part 7B which engages the threaded spindle 7A via at least one ball which is not shown. The thread part 7B in the illustrated example is connected to the first slide 8.

The first drive 7 preferably has a first motor 7C for drive or turning of the threaded spindle 7A or the ball screw or some other gearing.

In the illustrated example, the first slide 8 can therefore be moved or adjusted linearly or in the X direction by corresponding turning or rotation of the threaded spindle 7A.

To detect the position of the first slide 8 and/or as a limit switch for limiting the maximum adjustment, preferably a detection apparatus 7D is assigned to the first drive 7 and comprises, in the illustrated example, an especially motor-side switch and slide-side stops, as indicated schematically in FIG. 3. However, other implementations are also possible here.

The device 1 or the push-rod adjustment 6 preferably has a second drive 9 for pivoting of the fixture(s) 5A or lens(es) 2 and/or for (linear) actuation or adjustment of the push-rod 6A.

The second drive 9 is preferably located outside the working space 1A, especially underneath the bottom 1B and/or in a lower region of the device 1.

The device 1, the push-rod adjustment 6 or the second drive 9 preferably has a second slide 10 for linear movement or for actuating the push-rod 6A. The second slide 10 therefore enables the indicated pivoting around the pivoting axis S.

Preferably, the second drive 9 acts on the outer free end of the push-rod 6A in order to be able to move or adjust the push-rod 6A at least essentially in the X direction, and thus, to control or cause the pivoting around the pivoting axis S.

The push-rod 6A is preferably articulated via a joint 6J to the second drive 9 or second slide 10. However, also other designs are also possible.

Preferably, the second drive 9 is located on the first slide 8 and/or can be moved together with it. This results in that in the linear adjustment in the X direction, therefore in cross feed, or during displacement or movement by means of the first drive 7, no pivoting around the pivoting axis S takes place. Rather, the linear movement or adjustment of the lens 2 relative to the tool 3 in the X direction, on the one hand, and the pivoting of the lens 2 relative to the tool 3 around the pivoting axis S, on the other hand, can take place independently of one another by the first or second drive 7, 9.

In the illustrated example, a double slide arrangement is especially preferably formed. The second slide 10 sits especially on the first slide 8.

The second slide 10 is movably guided in particular on the first slide 8 or a rail 10A, preferably in the X direction or in the direction of the push-rod 6A.

The second drive 9 in the illustrated example preferably has a threaded spindle 9A for linear adjustment of the second slide 10. Especially preferably, the second drive 9 has a ball screw which is formed preferably by the threaded spindle 9A and an assigned thread part 9B which engages the threaded spindle 9A via at least one ball which is not shown.

The second drive 9 preferably has a motor 9C for driving or turning the threaded spindle 9A or the ball screw or some other gearing.

In the illustrated example, the second slide 10 can therefore be moved linearly or in the X direction by corresponding turning or rotation of the threaded spindle 9A.

To detect the position of the second slide 10 and/or as a limit switch for limiting the maximum adjustment, the second drive 9 is assigned preferably a detection apparatus 9D which, in the illustrated example, comprises an especially motor-side switch and slide-side stops, as is schematically indicated in FIG. 3. However, other implementations are also possible here.

It is noted that the second drive 9 or second slide 10 in FIG. 2 is shown in an upper position and in FIG. 3 in a lower position.

FIGS. 1 and 2 show the lenses 2 or lens drives 5 or fixtures 5A and motors 5B in one machining position. The fixtures 5A and lenses 2 point at the assigned tools 3 or at least essentially in the horizontal direction.

Figure 4:
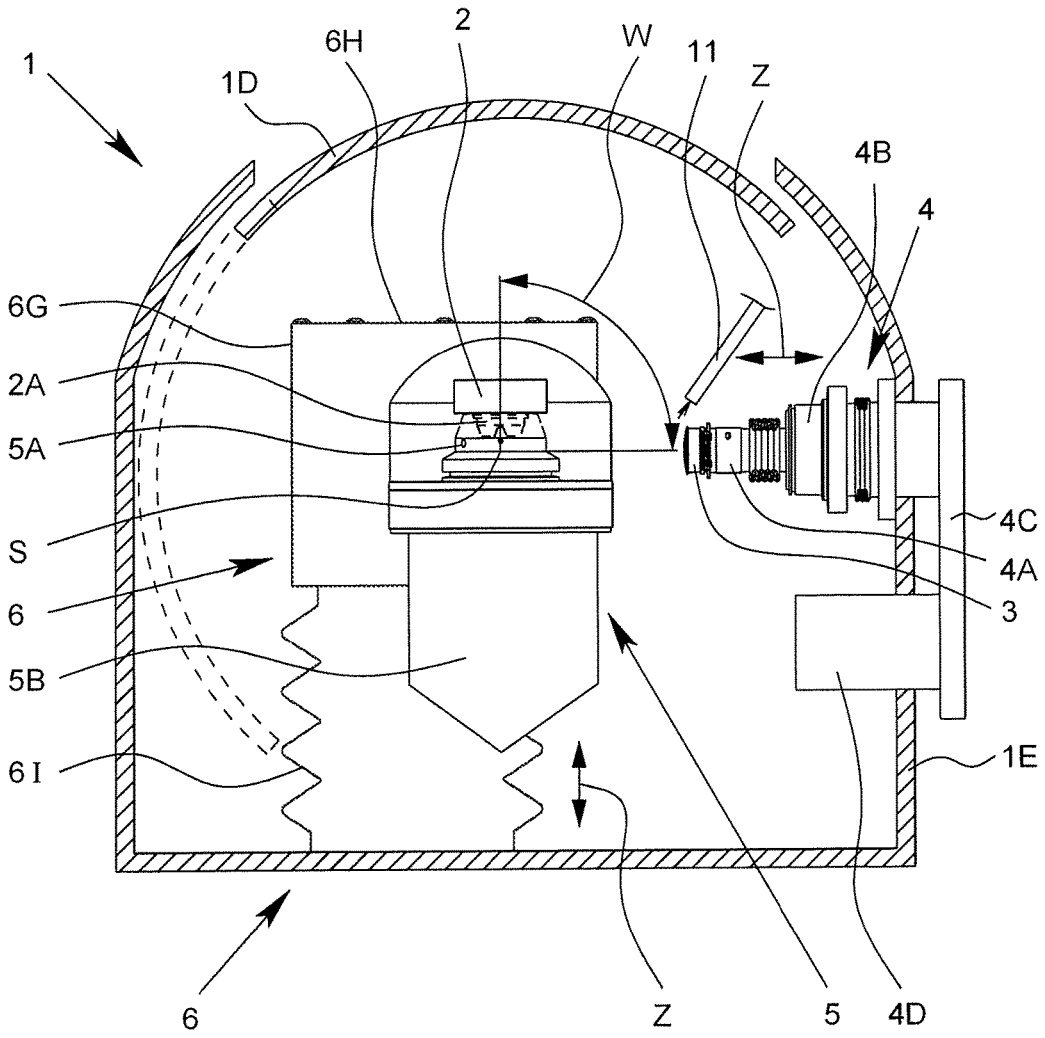
FIG. 4 is a schematic side view of an upper part of the device with the lens pivoted upward.

FIG. 4 shows a schematic section similar to FIG. 2 in which an upper part of the device 1 or the working space 1A, the lenses 2 or fixtures 5A or lens drives 5 are being pivoted up or pointing up, therefore in a change position.

To change the lenses 2 and/or tools 3, the working space 1A can be opened. The device 1 has especially a cover 1D which can be moved or swiveled preferably onto one side of the working space 1A and/or into the working space 1A, as is suggested in FIG. 4 by the broken line. The cover 1D preferably forms a domed cover. However, other designs are also possible.

The suggested device 1 and the suggested method call especially preferably for the fixtures 5A especially together with the assigned motors 5B to be able to pivot especially preferably by means of the push-rod adjustment 6 out of the machining position into the change position by an angle W, as suggested in FIG. 4. The angle W is preferably at least essentially 90°. In particular, pivoting takes place around the pivoting axis S out of the machining position which is at least essentially horizontally aligned, as suggested in FIGS. 1 and 2, into the at least essentially vertically aligned change position, as suggested in FIG. 4, and vice versa.

The lenses 2 can therefore preferably be inserted, removed and/or changed from overhead. This facilitates the changing of the lenses 2.

In the illustrated example, the lenses 2 are especially preferably held or clamped via their blocking piece 2A in the assigned fixture 5A. This can take place, for example, by a corresponding clamping apparatus and/or by, for example, automated chucking, clamping, suctioning, mounting or the like, for example, by an electrically motorized, hydraulic or pneumatic drive.

Required supply lines 6K, for example, for electrical power supply of the motors 5B and/or for automated chucking, holding, suctioning or clamping of the lenses 2 or blocking pieces 2A or the like, especially for electrical, pneumatic and/or hydraulic supply, are routed preferably through the push-rod adjustment 6 into the working space 1A and/or inside in the push-rod adjustment 6, as suggested in FIG. 2.

The supply lines 6K run especially through the retaining element 6F and the retaining head 6G and/or shaft segment 6D and the adjoining holders 6E, as suggested schematically in FIG. 2. The supply lines 6K can run along the push-rod 6A and/or can preferably helically surround it. The supply line 6K can if necessary also be attached to the push-rod 6A. But other designs are also possible here.

When the lenses 2 are being machined or polished, the lenses or the axes of rotation R can also be tilted relative to the axes of rotation D of the tools 3. In the proposed structure, this tilting can take place by any angle, theoretically up to 90° so that, in particular, there is no limitation of the tilt angle during machining, as in the prior art. Accordingly, especially also lenses 2 with very high diopters can be optimally machined or polished.

In the change position, the lenses 2 are swiveled away from the tools 3. Accordingly, also changing of the tools 3 is facilitated.

The lenses 2 and/or tools 3 can be alternately changed manually and/or automatically, especially preferably, by changing apparatus which are not shown.

Especially preferably, the changing of the lenses 2, on the one hand, and of the tools 3, on the other hand, can take place independently or separately, if necessary also at the same time, especially preferably by corresponding changing apparatus.

As already mentioned the illustrated device 1 is made preferably for simultaneous machining or for simultaneous polishing of two lenses 2, and accordingly, also preferably has two tools 3 which can be cross-linked in rotation for machining of the two lenses 2. However, fundamentally, the device 1 can also be made only for machining of one lens 2. In this case, a single lens drive 5 is sufficient. It can then be located especially on one side of the push-rod adjustment 6 or retaining head 6G. The lens drive 5 which is located on the other side can be omitted. Accordingly, then only a single tool drive 4 with a single tool 3 is also sufficient. The statements and explanations so far however apply accordingly.

The tool 3 can preferably be attached to the tool drive 4 via a coupling 4A. It is especially a plug-in coupling or the like.

Preferably, the tool 3 can be fed relative to the lens 2, especially in the Z direction or horizontal direction or in the direction of the axis of rotation D, as indicated in FIGS. 1, 2, and 4. This can take place especially by corresponding axial feed or adjustment of the tool drive 4 or a spindle 4B of the tool drive 4 or the like. The Z axis runs preferably parallel to the axis of rotation D.

The coupling 4A or spindle 4B can necessarily be driven directly or indirectly, for example, via a belt drive 4C, preferably from a motor 4D of the tool drive 4. In the illustrated example the motor 4D extends especially through one rear wall 1E of the working space 1A into the working space 1A, as suggested in FIGS. 2 and 4. The belt drive 4C and/or other components are preferably located outside the working space 1A, especially preferably behind the rear wall 1E. But other designs are also possible.

Preferably, the tool 3 is pressed or positioned with a predetermined or adjustable force against the lens 2 which is to be polished, here in the Z direction. The pressing or positioning can take place, for example, pneumatically, by spring force or in some other suitable way.

Furthermore, the tool 3 or the coupling 4A is preferably articulated to the tool drive 4 or its spindle 4B or the like or is held by it such that the tool 3 can tilt to the axis of rotation D and/or Z direction, and in this way, can abut and/or fit against the respective surface of the lens 2 which is to be polished. To do this, there is especially a corresponding joint, such as a ball joint or universal joint.

The polishing takes place preferably by lapping, especially therefore using a liquid which contains corresponding friction bodies, such as a so-called polishing milk or the like. Alternatively or in addition, the polishing can also take place by precision grinding. In particular, instead of lapping, also only pure precision grinding can take place for final machining of the lens 2, especially prior to subsequent coating of the lens 2.

Fundamentally, the workpieces (lens 2) and tool (polishing tool 3) can also be interchanged or a kinematic reversal can be implemented.

The term "axis" especially with respect to the linear axes X and Z is preferably understood within the scope of terminology in CNC controls (numerical or computerized controls) as a controlled or regulated or computed axis of movement.

The device 1 preferably has a memory-programmable control, CNC control or the like which is not shown.

The supply of a polishing agent, such as a polishing milk, takes place from obliquely overhead, for example, via a supply apparatus 11 which is schematically depicted in FIG. 4 and/or by the tool 3 or the tool drive 4.

What is claimed is:

1. A device for machining of an optical lens by means of a tool which can be turned around a turning axis, comprising:

a motor for rotating the lens, during machining, around an axis of rotation; and a working space in which the machining of the lens takes place;

a fixture positioned for holding a blocked lens in the working space and supporting the blocked lens during machining of the lens;

wherein the fixture is pivotable transversely to the axis of rotation in a vertical plane between a horizontal working orientation and an upward facing, lens changing position in which the lens can be changed from overhead around a pivoting axis running perpendicular to the axis of rotation by means of a push-rod adjustment device.

2. The device as claimed in claim 1, wherein the pivoting axis runs at least essentially horizontally.

3. The device as claimed in claim 1, comprising a second fixture positioned for holding a second lens at a location in said working space enabling machining of the second lens; and a second motor for simultaneous machining and rotating the second lens during machining.

4. The device as claimed in claim 3, wherein the fixtures are pivotable up together with said motors out of said working space around the pivoting axis.

5. The device as claimed in claim 1, wherein the fixture is pivotable around the pivoting axis by at least essentially 90 degrees.

6. The device as claimed in claim 1, wherein the motor together with the fixture is located in the working space.

7. The device as claimed in claim 1, wherein the tool is a polishing tool.

8. The device as claimed in claim 1, comprising a first drive for linear displacement of the fixture transverse to the turning axis.

9. The device as claimed in claim 8, wherein the first drive is at least one of located outside of the working space, is a linear drive, and has a ball screw.

10. The device as claimed in claim 8, further comprising a second drive for pivoting of the fixture.

11. The device as claimed in claim 10, wherein the second drive comprises a second slide for linear movement of a push-rod of the push-rod adjustment device.

12. The device as claimed in claim 10, wherein the second drive is located on a first slide which is movable by means of the first drive.

13. The device as claimed in claim 10, wherein the second drive is at least one of located outside the working space, is a linear drive, and has a ball screw.

14. A device for machining of an optical lens by means of a tool which can be turned around a turning axis, comprising:

a motor for rotating the lens during machining around an axis of rotation, the axis of rotation running at least essentially horizontally during machining in a machining position;

a working space in which the machining of the lens takes place;

a fixture positioned for holding a blocked lens in the working space and supporting the blocked lens during machining of the lens;

a first drive for linear displacement of the fixture transverse to the turning axis; and a second drive for pivoting the fixture by means of a push-rod adjustment device, wherein the second drive comprises a second slide for linear movement of a push-rod of the push-rod adjustment device, such that the fixture is pivotable in a vertical plane between a horizontal working orientation and an upward facing, lens changing position in which the lens can be changed from overhead around a pivoting axis by linear movement of said push-rod.

15. The device as claimed in claim 14, wherein the pivoting axis runs perpendicular to the axis of rotation.

16. The device as claimed in claim 14, wherein the pivoting axis runs at least essentially horizontally.

17. The device as claimed in claim 14, wherein the fixture is pivotable around the pivoting axis by at least essentially 90 degrees.

18. The device as claimed in claim 14, comprising a second fixture positioned for holding a second lens at a location in said working space enabling machining of the second lens; and a second motor for simultaneous machining and rotating of the second lens during machining.

19. The device as claimed in claim 18, wherein the fixtures are pivotable up together with the assigned motors out of the working space around the pivoting axis.

20. A device for machining optical lenses by means of tools which can be turned around turning axes, comprising:

a working space in which the machining of the lens takes place;

two fixtures in said working space for simultaneous holding of assigned lenses;

two motors for simultaneously rotating and machining the assigned lenses held by said fixtures around axes of rotation, the axes of rotation running at least essentially horizontally during machining in a machining position; and wherein the fixtures together with said motors are pivotable up out of the machining position around a pivoting axis in a vertical plane between a horizontal working orientation and an upward facing, lens changing position in which the lenses can be changed from overhead; and further comprising a first drive for linear displacement of the fixture transverse to the turning axis and a second drive for pivoting the fixture, wherein the second drive comprises a slide for linear movement of a push-rod of a push-rod adjustment device of the second drive.

21. The device as claimed in claim 20, wherein the pivoting axis runs perpendicular to the axis of rotation.

22. The device as claimed in claim 20, wherein the pivoting axis runs at least essentially horizontally.

23. The device as claimed in claim 20, wherein the fixture is pivotable around the pivoting axis by at least essentially 90 degrees.

* * * * *